US009453466B2

(12) United States Patent
Surnilla et al.

(10) Patent No.: US 9,453,466 B2
(45) Date of Patent: Sep. 27, 2016

(54) METHODS AND SYSTEMS FOR A FUEL SYSTEM

(71) Applicant: Ford Global Technologies, LLC, Dearborn, MI (US)

(72) Inventors: Gopichandra Surnilla, West Bloomfield, MI (US); Joseph F. Basmaji, Waterford, MI (US); Ross Dykstra Pursifull, Dearborn, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 661 days.

(21) Appl. No.: 13/773,442

(22) Filed: Feb. 21, 2013

(65) Prior Publication Data

US 2014/0230794 A1 Aug. 21, 2014

(51) Int. Cl.

| | |
|---|---|
| ***F02D 19/06*** | (2006.01) |
| ***F02M 37/08*** | (2006.01) |
| ***F02M 37/04*** | (2006.01) |
| ***F02M 37/00*** | (2006.01) |
| ***F02D 41/38*** | (2006.01) |
| *F02D 41/30* | (2006.01) |

(52) U.S. Cl.

CPC ..... *F02D 19/0605* (2013.01); *F02D 41/3854* (2013.01); *F02M 37/0058* (2013.01); *F02M 37/04* (2013.01); *F02M 37/08* (2013.01); *F02D 41/3082* (2013.01); *F02D 2200/0606* (2013.01); *F02D 2250/02* (2013.01)

(58) Field of Classification Search

CPC ..... F02D 2200/0611; F02D 19/022; F02D 41/3845; F02D 19/087; F02D 19/0605; F02D 41/3854; F02D 42/3082; F02D 2200/0606; F02D 2250/02; F02M 37/20; F02M 37/04; F02M 37/08; F02M 37/0058; G01N 33/2852

USPC ..... 123/458, 497, 541, 446, 447; 324/672; 73/335.04, 335.05, 862.338, 29.01; 701/102–104, 112

See application file for complete search history.

(56) References Cited

U.S. PATENT DOCUMENTS

| | | | | | |
|---|---|---|---|---|---|
| 2,976,720 | A * | 3/1961 | Callahan | G01N 27/223 | 73/61.43 |
| 4,260,333 | A * | 4/1981 | Schillinger | F02D 41/3082 | 123/458 |
| 4,479,116 | A * | 10/1984 | Kobayashi | G01N 27/223 | 340/620 |
| 4,484,822 | A * | 11/1984 | Hancock | G01N 25/08 | 374/16 |
| 4,905,655 | A * | 3/1990 | Maekawa | F02D 19/0684 | 123/1 A |
| 5,103,184 | A * | 4/1992 | Kapsokavathis | F02D 41/28 | 324/608 |
| 5,179,926 | A * | 1/1993 | Ament | F02D 41/0025 | 123/1 A |

(Continued)

FOREIGN PATENT DOCUMENTS

| | | | |
|---|---|---|---|
| DE | EP 1610125 | A1 * | 12/2005 |
| DE | 102009031159 | B3 * | 4/2011 |

(Continued)

*Primary Examiner* — Brian Kirby

(74) *Attorney, Agent, or Firm* — James Dottavio; Alleman Hall McCoy Russell & Tuttle LLP

(57) ABSTRACT

Various methods and system are described for a fuel system which includes a fuel composition sensor and a fuel lift pump disposed upstream of the sensor. The system may be operated in each of three different modes of operation. In each of the modes, a fuel lift pump voltage is adjusted responsive to a fuel capacitance output by the sensor, while a variable such as sensor temperature or fuel pump pressure is maintained depending on the mode of operation.

20 Claims, 5 Drawing Sheets

(56) References Cited

U.S. PATENT DOCUMENTS 5,205,151 A 4/1993 Shimamura et al.
5,232,006 A * 8/1993 Brehmer ..... G01F 1/74 137/183
5,363,314 A * 11/1994 Kobayashi ..... G01D 1/16 324/690
5,394,844 A * 3/1995 Akimoto ..... F02D 33/003 123/179.17
5,515,280 A * 5/1996 Suzuki ..... F02D 41/0025 123/1 A
5,528,928 A * 6/1996 Baker ..... G01M 15/06 361/290
5,586,539 A * 12/1996 Yonekawa ..... F02D 41/0042 123/458
6,065,436 A * 5/2000 Koga ..... F02D 41/062 123/179.17
6,382,184 B2 * 5/2002 Nakamura ..... F02D 41/042 123/464
6,564,624 B2 5/2003 Lin et al.
6,566,892 B2 * 5/2003 Schaefer ..... G01N 33/2852 324/601
6,615,807 B2 * 9/2003 Rembold ..... F02D 41/061 123/516
6,708,671 B1 * 3/2004 Joos ..... F02D 41/1401 123/464
6,840,219 B2 * 1/2005 Joos ..... F01P 1/06 123/41.31
6,880,392 B2 4/2005 Lee et al.
7,258,110 B2 * 8/2007 Kojima ..... F01N 3/20 123/456
7,272,485 B2 * 9/2007 Amano ..... F02D 41/0045 701/104
7,363,916 B2 * 4/2008 Eser ..... F02D 41/3082 123/497
7,431,024 B2 * 10/2008 Buchwitz ..... F02B 1/02 123/575
7,438,051 B2 * 10/2008 Wachtendorf ..... F02D 41/2464 123/446
7,640,916 B2 1/2010 Ulrey et al.
7,659,731 B2 * 2/2010 Lin ..... G01N 33/2852 324/439
7,743,750 B2 6/2010 Ritz et al.
7,789,068 B2 * 9/2010 Serra ..... F02D 41/3854 123/446
7,909,020 B2 * 3/2011 Orikabe ..... F02D 19/0605 123/457
8,061,329 B2 * 11/2011 Pursifull ..... F02D 41/2496 123/446
8,443,785 B2 * 5/2013 Carter ..... F02D 19/022 123/457
2003/0230249 A1 * 12/2003 Yamaoka ..... F02M 37/20 123/1 A
2004/0255647 A1 * 12/2004 Lin ..... G01N 33/2852 73/53.01
2006/0225706 A1 * 10/2006 Eser ..... F02D 41/3082 123/457
2008/0092834 A1 * 4/2008 Stein ..... F01L 13/0036 123/90.15
2009/0071444 A1 * 3/2009 Takagi ..... F02D 41/0025 123/447
2009/0090331 A1 4/2009 Pursifull
2010/0036593 A1 * 2/2010 Annoura ..... F02D 19/0628 701/115
2010/0126468 A1 * 5/2010 Martin ..... F02D 19/0647 123/447
2010/0229638 A1 * 9/2010 Nakamura ..... G01N 33/2829 73/114.43
2010/0241362 A1 * 9/2010 Yoshikawa ..... G01N 21/553 702/24
2010/0263647 A1 * 10/2010 Uchida ..... F02D 19/0602 123/704
2010/0282214 A1 * 11/2010 Albrecht ..... F02D 41/3854 123/457
2011/0106393 A1 * 5/2011 Pursifull ..... F02D 33/003 701/101
2011/0231082 A1 * 9/2011 Saruwatari ..... F02D 41/0042 701/104
2011/0264357 A1 * 10/2011 Sasai ..... F02D 41/0025 701/104
2012/0126835 A1 * 5/2012 Nakamura ..... G01N 33/2852 324/663
2012/0167859 A1 7/2012 Basmaji et al.
2012/0328452 A1 * 12/2012 Surnilla ..... F02M 37/0064 417/1

FOREIGN PATENT DOCUMENTS

EP 1610125 A1 * 12/2005 ..... F02D 2200/0606
EP 1995438 A1 * 11/2008 ..... F02D 19/0605
FR 2833040 A1 * 6/2003 ..... F02D 41/2438
JP 07198710 A * 8/1995 ..... G01N 33/22
JP 2005180222 A * 7/2005
JP 2010275909 A * 12/2010
JP 2011027041 A * 2/2011 ..... Y02T 10/123
WO WO 2008001532 A1 * 1/2008

* cited by examiner

METHODS AND SYSTEMS FOR A FUEL SYSTEM

TECHNICAL FIELD

The present application relates generally to a direct injection fuel system coupled to an internal combustion engine, the fuel system including a lower pressure pump and a higher pressure pump.

BACKGROUND AND SUMMARY

Some vehicle engine systems utilizing direct in-cylinder injection of fuel include a fuel delivery system that has multiple fuel pumps for providing suitable fuel pressure to fuel injectors. As one example, a fuel delivery system can utilize an electrically driven lower pressure pump (i.e., a fuel lift pump) and a mechanically driven higher pressure pump arranged respectively in series between the fuel tank and the fuel injectors along a fuel passage.

In such a configuration, the lift pump is operated to prevent unintended vaporization in the higher pressure pump. Low inlet fuel pressure, high fuel volatility, high higher pressure pump speed, and high higher pressure pump temperature in such a configuration may result in reduced pump volumetric efficiency and/or reduced lubrication of the higher pressure pump. As such, a measure of fuel volatility (e.g., fuel vapor pressure) may be used to determine a minimum required lift pump energy. However, this results in using more lift pump energy than needed to cover uncertainty in preventing unintended fuel vaporization, resulting in reduced fuel efficiency. Further, if an unanticipated pressure loss occurs (e.g., due to a clogged filter), a feedforward-only system cannot compensate for this, and fuel vaporization may occur, resulting in fuel starvation or pump lubrication issues.

The inventors herein have recognized the above issues, and have devised an approach to at least partially address them. Thus, a method for a gasoline direct injection engine system is disclosed. In one example, the method includes operating a fuel lift pump at a pressure within a threshold range above a fuel vapor pressure. The fuel vapor pressure may be determined based on a fuel capacitance sensor, for example.

By operating the fuel lift pump at a pressure greater than the fuel vapor pressure, the fuel may be prevented from vaporizing at the higher pressure pump. As such, fuel starvation and/or pump lubrication issues may be reduced. Further, because the vapor pressure is determined based on fuel capacitance from a sensor such as a fuel composition sensor, the sensor may provide feedback regarding the fuel vapor pressure such that the lift pump is not operated at a pressure higher than required and fuel system efficiency may be increased.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

DETAILED DESCRIPTION

The following description relates to methods and systems for a fuel composition sensor in a gasoline direct injection engine system. As will be described in detail herein, the sensor may be operated in each of three different modes of operation. In each of the modes, a lift pump voltage is adjusted responsive to a fuel capacitance output by the sensor, while a variable such as sensor temperature or fuel pump pressure is maintained depending on the mode of operation. For example, in a first mode of operation, a fuel lift pump pressure is maintained at a selected pressure above a fuel vapor pressure by adjusting the fuel lift pump voltage responsive to a fuel capacitance output by the sensor. In a second mode of operation, a temperature of the sensor is maintained at a selected temperature, and the fuel lift pump voltage is adjusted to adjust the fuel lift pump pressure responsive to an indication of fuel vaporization from the sensor. In a third mode of operation, the fuel lift pump voltage is adjusted to increase the fuel lift pump pressure responsive to an indication of fuel vaporization. By using the fuel capacitance output by the sensor to determine the level of fuel vaporization, the fuel lift pump voltage may be adjusted such that a chance of fuel vaporization within the fuel lift pump may be reduced. In this manner, fuel starvation and/or pump lubrication issues may be reduce, for example.

Figure 1:
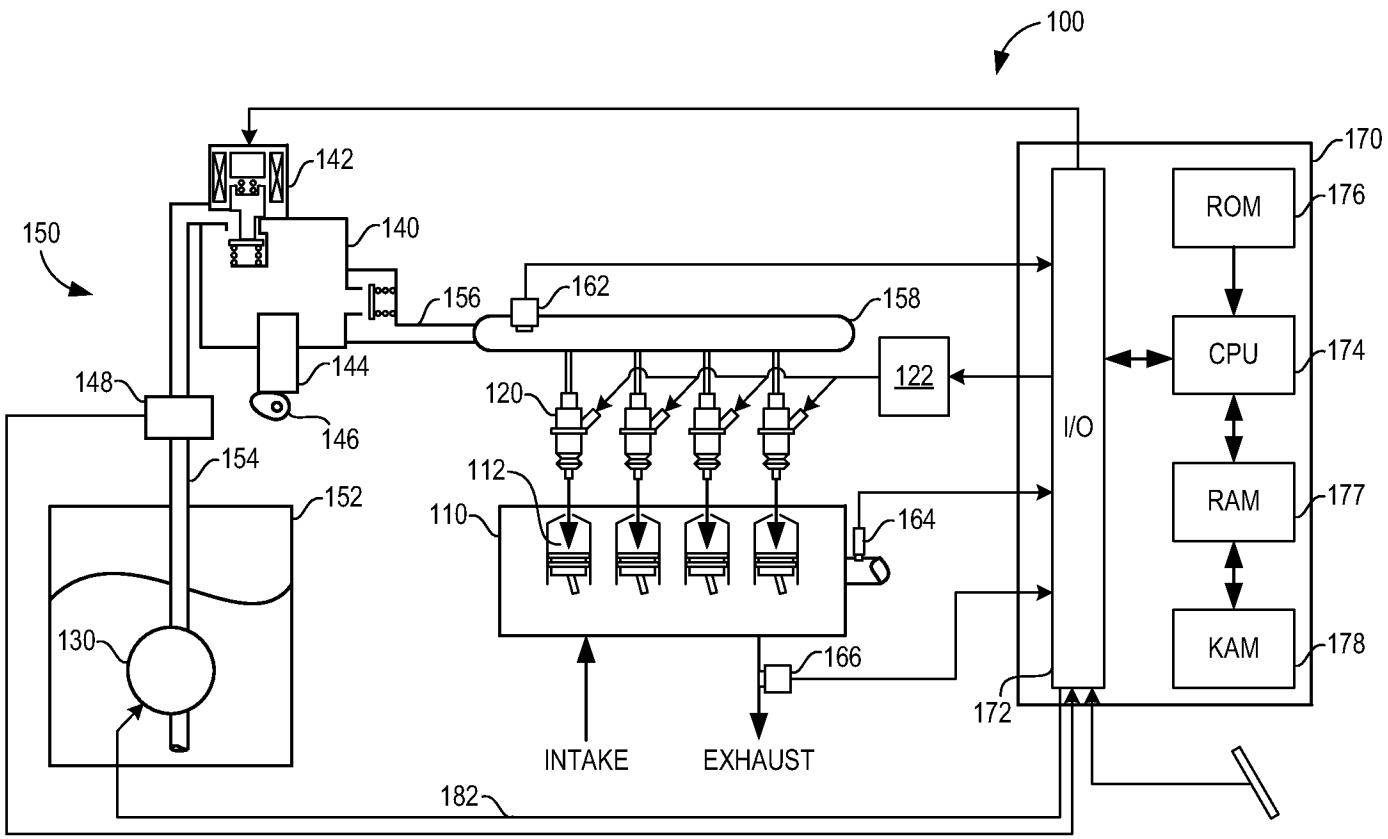
FIG. 1 shows an example embodiment of a fuel system coupled to an engine.

FIG. 1 shows a direct injection engine system 100, which may be configured as a propulsion system for a vehicle. The engine system 100 includes an internal combustion engine 110 having multiple combustion chambers or cylinders 112. Fuel can be provided directly to the cylinders 112 via in-cylinder direct injectors 120. As indicated schematically in FIG. 1, the engine 110 can receive intake air and exhaust products of the combusted fuel. The engine 110 may include a suitable type of engine including a gasoline or diesel engine.

Fuel can be provided to the engine 110 via the injectors 120 by way of a fuel system indicated generally at 150. In this particular example, the fuel system 150 includes a fuel storage tank 152 for storing the fuel on-board the vehicle, a lower pressure fuel pump 130 (e.g., a fuel lift pump), a higher pressure fuel pump 140, a fuel rail 158, and various fuel passages 154 and 156. In the example shown in FIG. 1, the fuel passage 154 carries fuel from the lower pressure pump 130 to the higher pressure fuel pump 140, and the fuel passage 156 carries fuel from the higher pressure fuel pump 140 to the fuel rail 158.

The lower pressure fuel pump 130 can be operated by a controller 170 to provide fuel to higher pressure fuel pump 140 via fuel passage 154. The lower pressure fuel pump 130 can be configured as what may be referred to as a fuel lift pump. As one example, lower pressure fuel pump 130 can include an electric pump motor, whereby the pressure increase across the pump and/or the volumetric flow rate through the pump may be controlled by varying the electrical power provided to the pump motor, thereby increasing or decreasing the motor speed. For example, as the controller 170 reduces the electrical power that is provided to pump 130, the volumetric flow rate and/or pressure increase across the pump may be reduced. The volumetric flow rate and/or pressure increase across the pump may be increased by increasing the electrical power that is provided to the pump 130. As one example, the electrical power supplied to the lower pressure pump motor can be obtained from an alternator or other energy storage device on-board the vehicle (not shown), whereby the control system can control the electrical load that is used to power the lower pressure pump. Thus, by varying the voltage and/or current provided to the lower pressure fuel pump, as indicated at 182, the flow rate and pressure of the fuel provided to higher pressure fuel pump 140 and ultimately to the fuel rail may be adjusted by the controller 170.

The higher pressure fuel pump 140 can be controlled by the controller 170 to provide fuel to the fuel rail 158 via the fuel passage 156. As one non-limiting example, higher pressure fuel pump 140 may be a BOSCH HDP5 HIGH PRESSURE PUMP, which utilizes a flow control valve (e.g., MSV) indicated at 142 to enable the control system to vary the effective pump volume of each pump stroke. However, it should be appreciated that other suitable higher pressure fuel pumps may be used. The higher pressure fuel pump 140 may be mechanically driven by the engine 110 in contrast to the motor driven lower pressure fuel pump 130. A pump piston 144 of the higher pressure fuel pump 140 can receive a mechanical input from the engine crank shaft or cam shaft via a cam 146. In this manner, higher pressure pump 140 can be operated according to the principle of a cam-driven single-cylinder pump.

As depicted in FIG. 1, a fuel composition sensor 148 is disposed downstream of the fuel lift pump 130. The fuel composition sensor 148 may operate based on fuel capacitance, or the number of moles of a dielectric fluid within its sensing volume. For example, an amount of ethanol (e.g., liquid ethanol) in the fuel may be determined (e.g., when a fuel alcohol blend is utilized) based on the capacitance of the fuel. Further, the fuel composition sensor may be used to determine humidity (e.g., gas). Thus, the fuel composition sensor may be used to determine a level of vaporization of the fuel, as fuel vapor has a smaller number of moles within the sensing volume than liquid fuel. As such, fuel vaporization may be indicated when the fuel capacitance drops off. As described in greater detail with reference to FIGS. 3-5, the fuel composition sensor 148 may be utilized to determine the level of fuel vaporization of the fuel such that the controller 170 may adjust the lift pump pressure in order to reduce fuel vaporization within the fuel lift pump 130.

Further, in some examples, the higher pressure pump 140 may be operated as the fuel composition sensor to determine the level of fuel vaporization. For example, a piston-cylinder assembly of the higher pressure pump 140 forms a fluid-filled capacitor. As such, the piston-cylinder assembly allows the pump 140 to be the capacitive element in the fuel composition sensor. In some examples, the piston-cylinder assembly of the higher pressure pump 140 may be the hottest point in the system, such that fuel vapor forms there first. In such an example, the higher pressure pump 140 may be utilized as the sensor for detecting fuel vaporization, as fuel vaporization may occur at the piston-cylinder assembly before it occurs anywhere else in the system.

As shown in FIG. 1, the fuel rail 158 includes a fuel rail pressure sensor 162 for providing an indication of fuel rail pressure to the controller 170. An engine speed sensor 164 can be used to provide an indication of engine speed to the controller 170. The indication of engine speed can be used to identify the speed of higher pressure fuel pump 140, since the pump 140 is mechanically driven by the engine 110, for example, via the crankshaft or camshaft. An exhaust gas sensor 166 can be used to provide an indication of exhaust gas composition to the controller 170. As one example, the sensor 166 may include a universal exhaust gas sensor (UEGO). The exhaust gas sensor 166 can be used as feedback by the controller to adjust the amount of fuel that is delivered to the engine via the injectors 120. In this way, the controller 170 can control the air/fuel ratio delivered to the engine to a prescribed setpoint.

The controller 170 can individually actuate each of the injectors 120 via a fuel injection driver 122. The controller 170, the driver 122, and other suitable engine system controllers can comprise a control system. While the driver 122 is shown external to the controller 170, it should be appreciated that in other examples, the controller 170 can include the driver 122 or can be configured to provide the functionality of the driver 122. The controller 170, in this particular example, includes an electronic control unit comprising one or more of an input/output device 172, a central processing unit (CPU) 174, read-only memory (ROM) 176, random-accessible memory (RAM) 177, and keep-alive memory (KAM) 178. The storage medium ROM 176 can be programmed with computer readable data representing non-transitory instructions executable by the processor 174 for performing the methods described below as well as other variants that are anticipated but not specifically listed.

Figure 2:
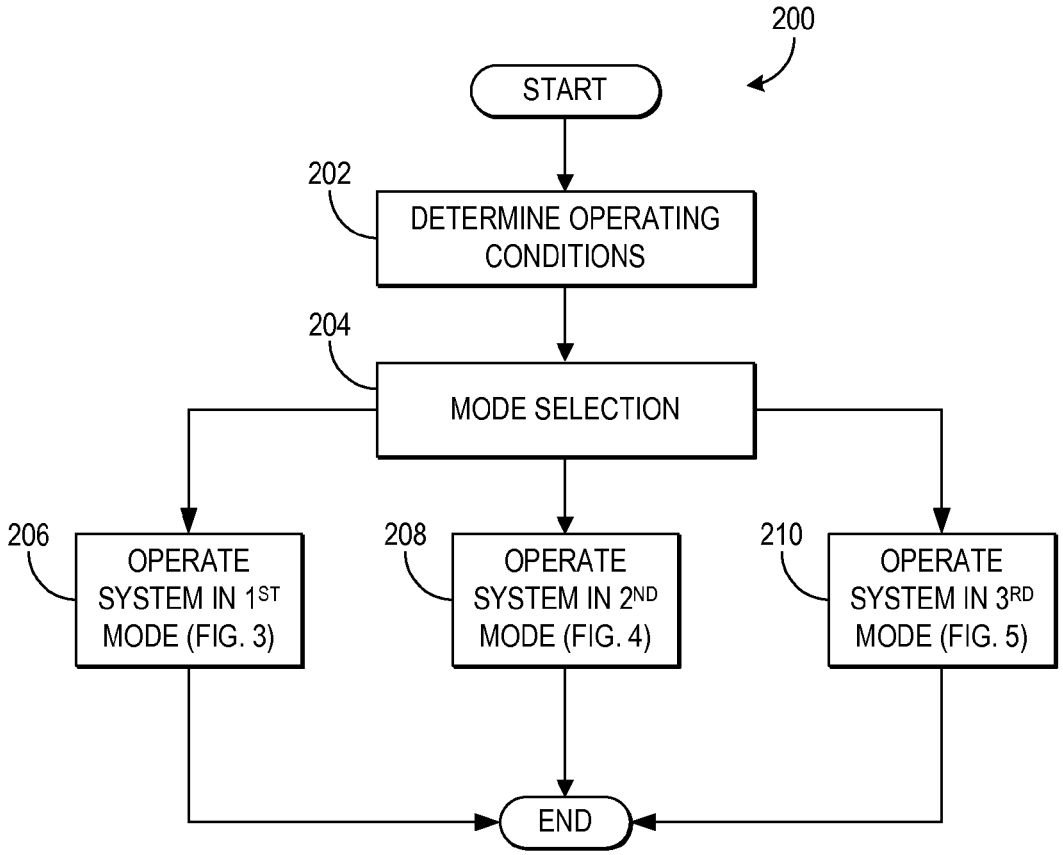
FIG. 2 shows a flow chart illustrating a routine for determining a mode of operation of a fuel system.
Figure 3:
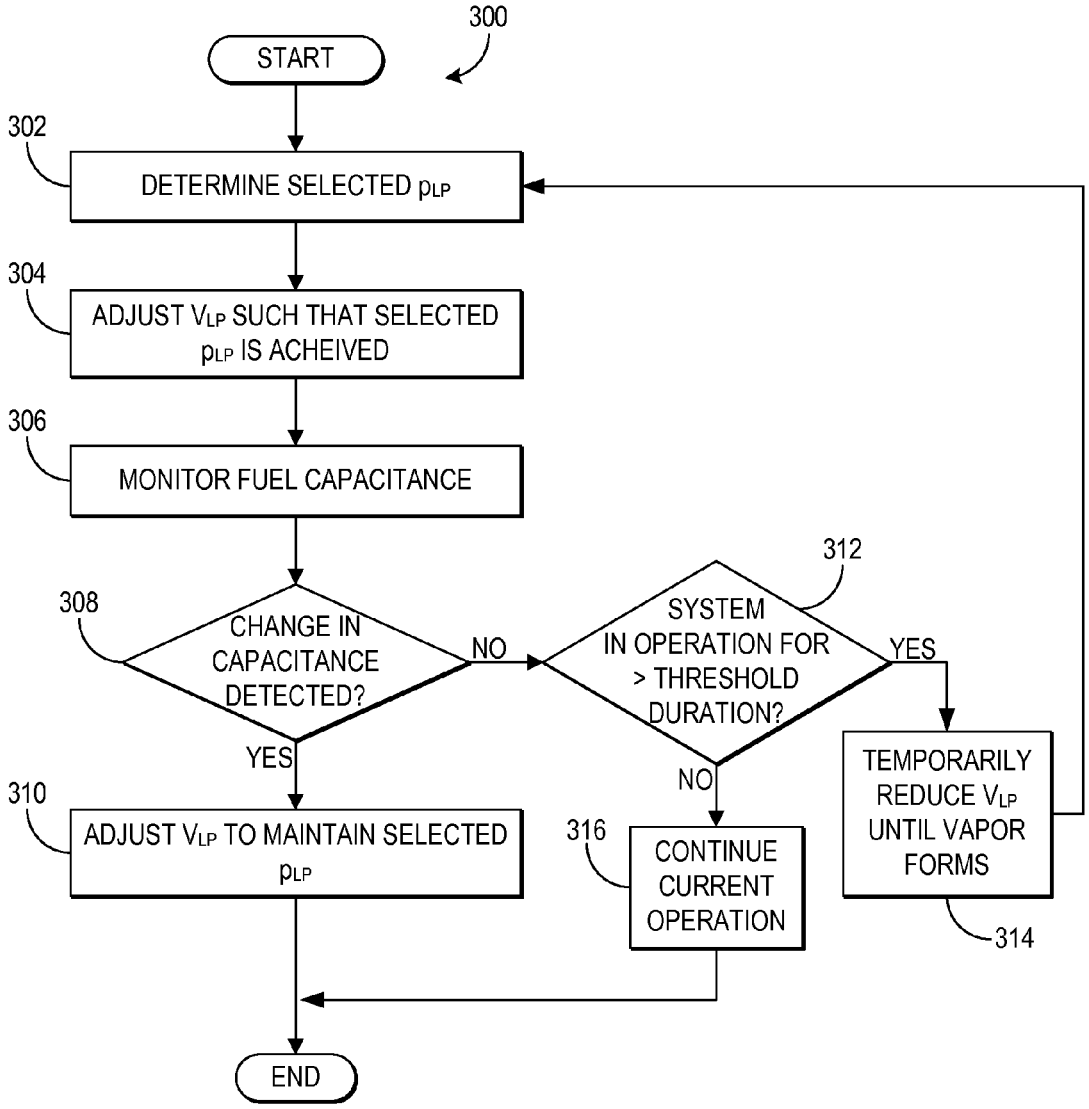
FIG. 3 shows a flow chart illustrating a routine for a first mode of operation of a fuel system.
Figure 4:
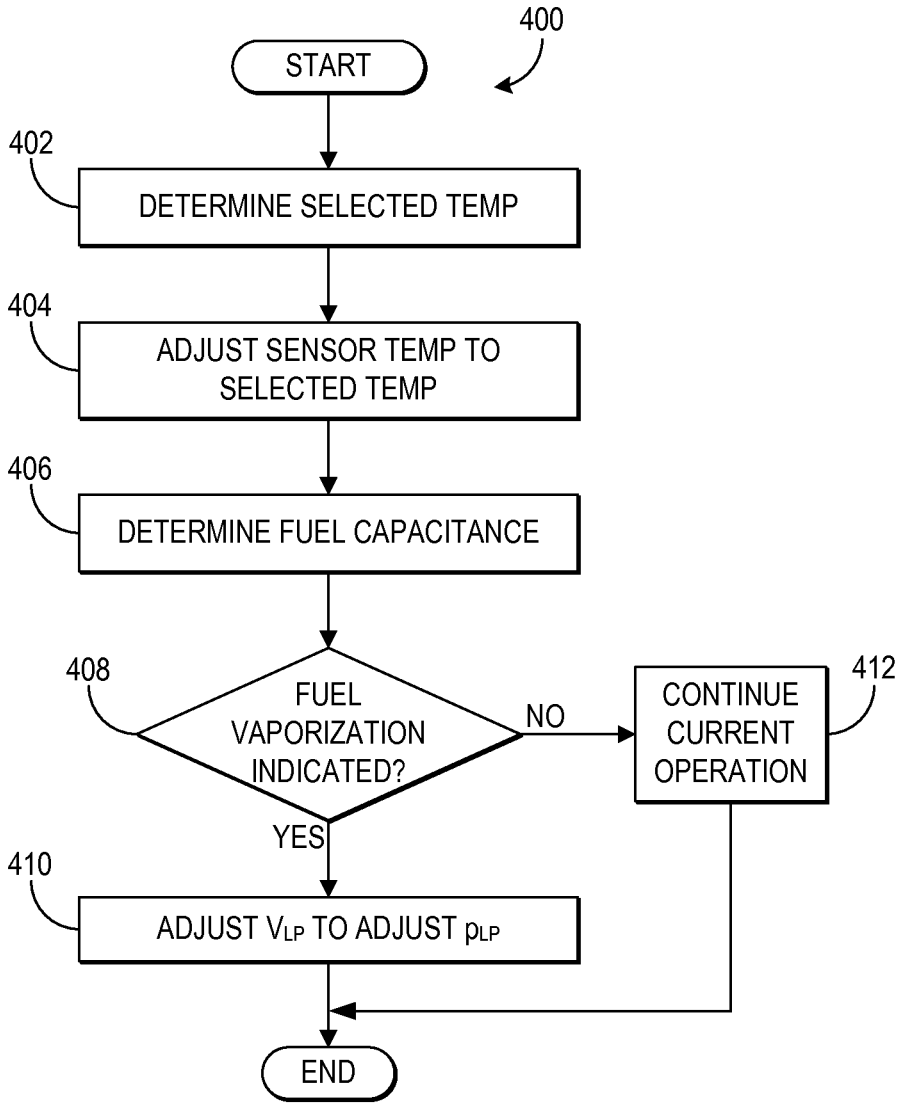
FIG. 4 shows a flow chart illustrating a routine for a second mode of operation of a system.
Figure 5:
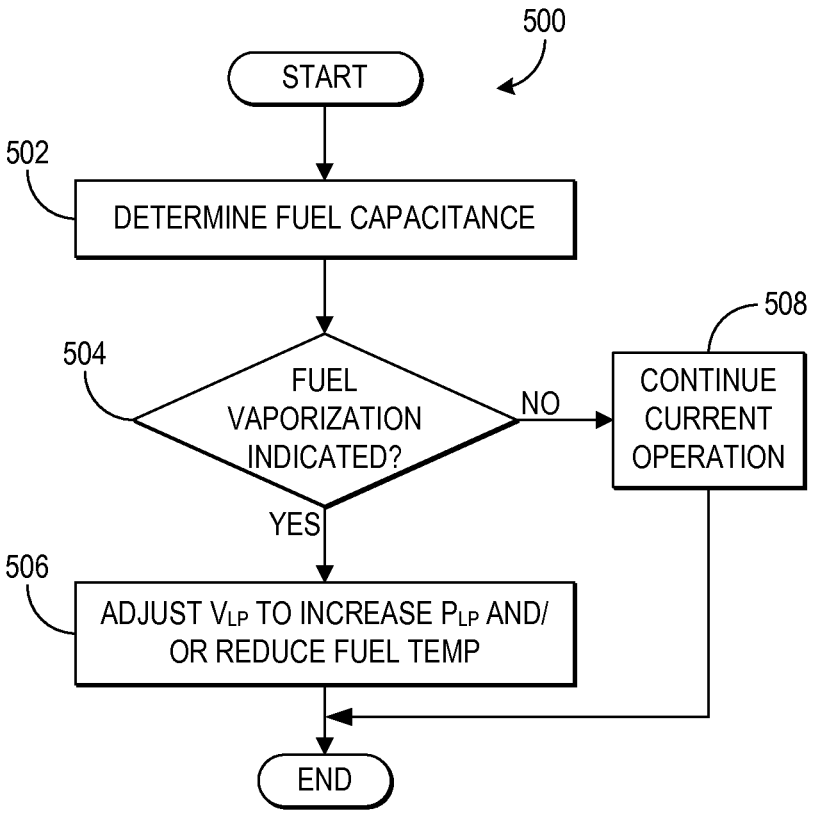
FIG. 5 shows a flow chart illustrating a routine for a third mode of operation of a fuel system.

FIGS. 2-5 show flow charts illustrating routines for a fuel system, such as the fuel system 150 described above with reference to FIG. 1. In particular, FIG. 2 shows a flow chart which determines in which mode of operation a fuel system including a fuel composition sensor and a fuel lift pump should be operated. In some examples, the fuel composition sensor may be disposed between the fuel lift pump and a higher pressure pump, such as in the example described above with reference to FIG. 1. In other examples, the fuel composition sensor may be the higher pressure pump 140, for example. FIGS. 3-5 show first, second, and third modes of operation, respectively. It should be understood, each mode of operation is carried out independently of the other modes of operation, such that the system operates according to only one of the three modes of operation at any given time.

FIG. 2 shows a flow chart illustrating a routine 200 for selecting a mode of operation for a fuel system including a fuel composition sensor and a fuel lift pump, such as the fuel composition sensor 148 and fuel lift pump 130 described above with reference to FIG. 1. Specifically, the routine selects the mode of operation of the system.

At 202, operating conditions are determined based on various sensors in the system, including those described above with reference to FIG. 1. For example, the operating conditions may include fuel rail pressure, speed of the higher pressure pump (e.g., based on engine speed), exhaust air/fuel ratio, requested engine output, fuel temperature, ambient air temperature and/or pressure, etc.

Once the operating conditions are determined, the routine proceeds to 204 where mode selection occurs. The system may be operated in one of three modes in which the fuel lift pump is controlled such that fuel vaporization is reduced without reducing the efficiency of the system.

When the routine proceeds to 206, the system is operated in the first mode, as described below with reference to FIG. 3. When the routine proceeds to 208, the system is operated in the second mode, as described below with reference to FIG. 4. When the routine proceeds to 210, the system is operated in the third mode, as described below with reference to FIG. 5.

Continuing to FIG. 3, a flow chart illustrating a routine 300 for a first mode of operation of the fuel system is shown. Specifically, in the first mode of operation, the sensor is operated to maintain a pressure of the fuel lift pump above a fuel vapor pressure such that fuel vaporization does not occur. As such, the first mode is an active control mode in which the control action is lift pump voltage which varies the lift pump pressure and the feedback signal is fuel capacitance.

At 302, a selected, or predetermined, fuel lift pump pressure ($p_{LP}$) is determined. For example, the selected pressure may be just above the fuel vaporization point. As one example, the selected pressure may be a pressure within a predetermined range of the fuel vapor pressure. For example, the selected pressure may be within 5 to 10 psi or 10-20 psi greater than the fuel vapor. By maintaining the fuel lift pump pressure at a pressure just above the fuel vaporization point, the fuel may be prevented from vaporizing within the fuel lift pump. As such, fuel starvation and/or pump lubrication issues may be reduced.

At 304, the controller adjusts the lift pump voltage ($V_{LP}$) such that the selected pressure is achieved. As described above, the fuel lift pump is an electrically driven pump; thus, by varying the voltage provided to the lift pump, the pressure of the fuel output by the lift pump is varied. For example, if the lift pump pressure is less than the selected pressure, the voltage is adjusted such that the lift pump pressure is increased. Alternatively, if the lift pump pressure is greater than the selected pressure, the voltage is adjusted such that lift pump pressure is reduced.

At 306, a fuel capacitance signal output by the sensor is monitored. As such, the fuel capacitance (e.g., level of fuel vaporization) provides a feedback signal.

At 308, it is determined if there is a change in fuel capacitance. For example, it is determined if the fuel capacitance has increased or decreased, indicating a change in the level of fuel vaporization.

If it is determined that there is a change in fuel capacitance, the routine moves to 310 where the lift pump voltage is adjusted in order to maintain the selected lift pump pressure ($p_{LP}$). On the other hand, if it is determined that there is no change in the fuel capacitance, the routine moves to 312 where it is determined if the system has been operating for greater than a threshold duration. The threshold duration may be a set amount of time, such as five minutes, ten minutes, one hour, etc., or the threshold duration may be based on the operating conditions. As one example, the threshold duration may be smaller when the engine is operating under a high load compared with low load operation.

If it is determined that the system has not been operating for greater than the threshold duration, the routine moves to 316 where current operation is continued and the sensor is operated as a fuel composition sensor. On the other hand, if it is determined that the system has been operating for greater than the threshold duration, the routine continues to 314 where the lift pump pressure is temporarily reduced to the point that fuel vapor forms (e.g., fuel vaporization is detected by the fuel composition sensor). In this manner, the system may verify that it is not expending more lift pump energy than needed to maintain a liquid phase of the fuel and reduce fuel vaporization. The routine then returns to 302 where a selected pressure is determined. If the current pressure is too high, for example, the selected pressure may be reduced.

Thus, in the first mode of operation, the lift pump pressure is actively managed to keep the lift pump pressure at the selected pressure above the fuel vaporization point. By maintaining the lift pump pressure above the fuel vaporization point, a chance of fuel vaporization occurring at the lift pump may be reduced. In this way, fuel starvation and/or pump lubrication issues may be reduced. Further, by using the fuel capacitance as a feedback signal, the lift pump pressure may be maintained at a pressure that is not too high such that the efficiency of the system is not reduced.

FIG. 4 shows a flow chart illustrating a routine 400 for a second mode of operation of the sensor. Specifically, in the second mode of operation, a temperature of the sensor (or a temperature at a location at which fuel capacitance is measured) is maintained at a temperature which is greater than that of a higher pressure pump disposed downstream of the sensor, such as the mechanically driven higher pressure pump 140 described above with reference to FIG. 1. As such, the second mode is a control mode of operation in which the temperature of the sensor is controlled.

At 402, a selected, or predetermined, temperature is determined. The selected temperature may be determined based on a fuel vaporization point of the fuel and/or a temperature of the higher pressure pump. As an example, the selected temperature may be within a predetermined range above a bulk fuel temperature. For example, the selected temperature may be 10-15° C. above the bulk fuel temperature. By maintaining the sensor temperature at a temperature greater than the bulk fuel temperature, any vaporization of the fuel that occurs, first occurs at the sensor.

At 404 the temperature of the sensor, or at the location where the fuel capacitance is obtained, is adjusted to the selected temperature. For example, the sensor or higher pressure pump may include a heater, such as a resistive heater or the like, to increase the temperature.

At 406, the fuel capacitance is determined based on the sensor output (e.g., a signal is sent to the controller). A level of fuel vaporization is determined based on the fuel capacitance, and at 408, it is determined if fuel vaporization is indicated. For example, as described above, the fuel composition sensor is based on fuel capacitance. Because fuel vapor has a lower dielectric value than liquid fuel, fuel vaporization may be determined. Thus, fuel vaporization may be indicated if the fuel capacitance falls within a predetermined range of the fuel capacitance of fuel vapor, for example If it is determined that fuel vaporization is not indicated, the routine moves to 412 where current operation is continued and the sensor is operated as a fuel composition sensor. On the other hand, if it is determined that fuel vaporization is indicated, the lift pump voltage is adjusted to adjusted the lift pump pressure at 410. As described above, the fuel lift pump is an electrically driven pump; thus, by varying the voltage provided to the lift pump, the pressure of the fuel output by the lift pump is varied. By varying the lift pump pressure responsive to an indication of fuel vaporization at the sensor, a chance of fuel vaporization in the higher pressure pump may be reduced, as the lift pump pressure is adjusted before the bulk of the fuel reaches a vaporization point.

Thus, in the second mode of operation, the sensor temperature is maintained at a temperature greater than the bulk fuel temperature such that if fuel vaporization occurs, it occurs at the sensor first. Responsive to the indication of fuel vaporization from the sensor, the fuel lift pump pressure is adjusted in order to reduce a chance of fuel vaporization occurring elsewhere in the system, such as in the higher pressure pump, and fuel starvation and/or pump lubrication issues may be reduced.

A flow chart illustrating a routine 500 for operating the sensor in the third mode of operation is shown in FIG. 5. Specifically, in the third mode of operation, the sensor is operated at current pressure and temperature conditions, such that the third mode of operation is a passive mode of operation. Responsive to an indication of fuel vaporization, at least one of fuel temperature and lift pump pressure may be adjusted, as described below.

At 502, the fuel capacitance is determined based on the sensor output. A level of fuel vaporization is determined based on the fuel capacitance, and at 504, it is determined if fuel vaporization is indicated. For example, as described above, the fuel composition sensor is based on fuel capacitance. Because fuel vapor has a lower dielectric value than liquid fuel, fuel vaporization may be determined. Thus, fuel vaporization may be indicated if the fuel capacitance falls within a predetermined range of the fuel capacitance of fuel vapor, for example.

If it is determined that fuel vaporization is not indicated, the routine moves to 510 where current operation is continued and the sensor is operated as a fuel composition sensor. On the other hand, if it is determined that fuel vaporization is indicated, the routine continues to 506 where the lift pump pressure is adjusted and/or a fuel temperature is reduced. The fuel lift pump pressure may adjusted by adjusting the lift pump voltage, for example, as described above. The fuel temperature may be reduced via a heat exchanger, for example.

Thus, in the third mode of operation, current operation of the system continues until fuel vaporization is indicated, such that the third mode of operation is a passive mode of operation. Once fuel vaporization is indicated, the lift pump pressure is adjusted and/or the fuel temperature is adjusted. In this manner, efficiency of the fuel system may be maintained or increased.

Note that the example control and estimation routines included herein can be used with various engine and/or vehicle system configurations. The specific routines described herein may represent one or more of any number of processing strategies such as event-driven, interrupt-driven, multi-tasking, multi-threading, and the like. As such, various acts, operations, or functions illustrated may be performed in the sequence illustrated, in parallel, or in some cases omitted. Likewise, the order of processing is not necessarily required to achieve the features and advantages of the example embodiments described herein, but is provided for ease of illustration and description. One or more of the illustrated acts or functions may be repeatedly performed depending on the particular strategy being used. Further, the described acts may graphically represent code to be programmed into the computer readable storage medium in the engine control system.

It will be appreciated that the configurations and routines disclosed herein are exemplary in nature, and that these specific embodiments are not to be considered in a limiting sense, because numerous variations are possible. For example, the above technology can be applied to V-6, I-4, I-6, V-12, opposed 4, and other engine types. The subject matter of the present disclosure includes all novel and nonobvious combinations and subcombinations of the various systems and configurations, and other features, functions, and/or properties disclosed herein.

The following claims particularly point out certain combinations and subcombinations regarded as novel and nonobvious. These claims may refer to "an" element or "a first" element or the equivalent thereof. Such claims should be understood to include incorporation of one or more such elements, neither requiring nor excluding two or more such elements. Other combinations and subcombinations of the disclosed features, functions, elements, and/or properties may be claimed through amendment of the present claims or through presentation of new claims in this or a related application.

Such claims, whether broader, narrower, equal, or different in scope to the original claims, also are regarded as included within the subject matter of the present disclosure.

The invention claimed is:

1. A method for a gasoline direct injection engine system, comprising:

monitoring fuel capacitance via a fuel composition sensor arranged in a fuel passage between a fuel lift pump and a higher pressure pump;

determining a fuel vapor pressure and an amount of ethanol in the fuel based on the fuel capacitance;

based on the fuel vapor pressure, adjusting the fuel lift pump to a selected pressure within a threshold range above a fuel vaporization point; and if the system has been operating for greater than a threshold duration and no change in capacitance has been detected, temporarily reducing pressure at the fuel lift pump until fuel vaporization is detected by the fuel composition sensor, and then adjusting the selected pressure based on the fuel lift pump pressure at which fuel vaporization was detected.

2. The method of claim 1, wherein the higher pressure pump operates at a higher pressure than the fuel lift pump.

3. The method of claim 1, further comprising, responsive to the fuel capacitance exceeding a threshold capacitance, adjusting the fuel lift pump pressure.

4. The method of claim 1, further comprising, in a second mode, maintaining a temperature at a predetermined temperature at a location where the fuel capacitance is obtained, and adjusting the fuel lift pump pressure responsive to an indication of fuel vaporization.

5. The method of claim 1, further comprising, in a third mode, responsive to an indication of fuel vaporization, increasing the fuel lift pump pressure or reducing a fuel temperature.

6. A method for a fuel system including a fuel composition sensor and a fuel lift pump, comprising:

monitoring fuel capacitance via the fuel composition sensor;

determining a fuel vapor pressure and an amount of ethanol in the fuel based on the fuel capacitance;

in a first mode, maintaining a fuel lift pump pressure at a selected pressure above the fuel vapor pressure, and adjusting a fuel lift pump voltage responsive to the fuel capacitance;

if the fuel system has been operating for greater than a threshold duration and no change in capacitance has been detected, temporarily reducing fuel lift pump pressure until fuel vaporization is detected by the fuel composition sensor, and adjusting the selected pressure based on the reduced fuel lift pump pressure at which fuel vaporization was detected;

in a second mode, maintaining a temperature of the sensor at a selected temperature, and adjusting the fuel lift pump pressure responsive to an indication of fuel vaporization, the indication responsive to the fuel vapor pressure which is based on the fuel capacitance; and in a third mode, increasing the fuel lift pump pressure responsive to the indication of fuel vaporization.

7. The method of claim 6, wherein the fuel composition sensor is disposed in a fuel passage downstream of the fuel lift pump and upstream of a higher pressure pump which operates at a higher pressure than the fuel lift pump.

8. The method of claim 6 further comprising, in the third mode, reducing a fuel temperature responsive to the indication of fuel vaporization.

9. The method of claim 6, wherein the fuel lift pump voltage in the first mode is adjusted independent of the fuel lift pump voltage in the second mode.

10. The method of claim 6, wherein the fuel lift pump voltage in the first mode is adjusted independent of the fuel lift pump voltage in the third mode.

11. The method of claim 6, further comprising, operating the fuel system in only one of the first, second, or third modes at one time.

12. The method of claim 6, wherein the fuel composition sensor is part of a gasoline direct injection engine system.

13. A fuel system, comprising:

a fuel lift pump;

a sensor positioned downstream of the fuel lift pump in a fuel passage, and configured to output a signal indicating fuel capacitance; and a control system in communication with the sensor, the control system including non-transitory instructions to, during a first mode of operation of the fuel system:

monitor fuel capacitance via the sensor;

responsive to detection of a change in fuel capacitance, adjust a fuel lift pump voltage to maintain a fuel lift pump pressure at a selected pressure above a fuel vaporization point;

if no change in fuel capacitance has been detected, and if the fuel system has been operating for greater than a threshold duration, temporarily reduce fuel lift pump pressure until fuel vaporization is detected by the sensor, and adjust the selected pressure based on the fuel lift pump pressure at which fuel vaporization was detected; and if no change in fuel capacitance has been detected, and if the fuel system has not been operating for greater than the threshold duration, continue current operation and operate the sensor as a fuel composition sensor.

14. The fuel system of claim 13, wherein the control system further includes instructions to, in a second mode of operation, adjust the fuel lift pump voltage responsive to an indication of fuel vaporization, the indication of fuel vaporization based on the fuel capacitance, and maintain a temperature of the sensor at a selected temperature.

15. The fuel system of claim 13, wherein the control system further includes instructions to, in a third mode of operation, adjust the fuel lift pump voltage responsive to an indication of fuel vaporization, the indication of fuel vaporization based on the fuel capacitance, and increase the fuel lift pump pressure responsive to the indication of fuel vaporization.

16. The fuel system of claim 13, wherein the fuel system is part of a gasoline direct injection engine system.

17. The method of claim 1, wherein the threshold duration is smaller when the engine system is operating under a higher load compared with the threshold duration when the engine is operating under a lower load.

18. The method of claim 1, further comprising, if the system has not been operating for greater than the threshold duration, continuing current operation.

19. The method of claim 6, further comprising, during operation in the first mode, if the fuel system has not been operating for greater than the threshold duration, operating the sensor as the fuel composition sensor, wherein the threshold duration is smaller when an engine is operating under a higher load compared with the threshold duration when the engine is operating under a lower load.

20. The fuel system of claim 14, wherein the threshold duration is smaller when an engine is operating under a higher load compared with the threshold duration when the engine is operating under a lower load.

* * * * *